United States Patent [19]

Farr et al.

[11] 4,266,450

[45] May 12, 1981

[54] POWER TONG ASSEMBLY

[75] Inventors: Garth M. Farr, Kingwood, Tex.; Terence D. McCoy, Edmonton, Canada

[73] Assignee: Farr Oil Tool, Inc., Houston, Tex.

[21] Appl. No.: 6,904

[22] Filed: Jan. 26, 1979

[51] Int. Cl.[3] ..... B25B 13/50

[52] U.S. Cl. ..... 81/57.33; 81/57.18; 81/57.2

[58] Field of Search ..... 81/57.15, 57.18, 57.19, 81/57.2, 57.21, 57.33

[56] References Cited

U.S. PATENT DOCUMENTS

| | | | |
|---|---|---|---|
| 2,879,680 | 3/1959 | Beeman et al. | 81/57.18 |
| 3,021,739 | 2/1962 | Grundman | 81/57.19 |
| 3,550,485 | 12/1970 | Dickmann | 81/57.15 |
| 4,084,453 | 4/1978 | Eckel | 81/57.19 |

*Primary Examiner*—James L. Jones, Jr.
*Attorney, Agent, or Firm*—Arnold, White & Durkee

[57] ABSTRACT

In a power tong of the type used in making up and breaking out threaded connections between pipe sections, the bearing surface between the upper cage plate and the tong top body plate is provided with improved means for reducing friction and other undesirable forces when the cage plate is rotatably driven with respect to the body plate. In a particular embodiment, the upper cage plate is provided with an arcuate groove which opens toward the opposing top body plate. The groove includes guide rollers mounted on vertical shafts for engaging the inner and outer arcuate walls of the groove to guide the cage plate when it is rotated. The groove also includes weight relief rollers mounted on horizontal shafts for providing a gap between the upper cage plate and its opposing body plate to eliminate metal-to-metal friction therebetween.

7 Claims, 5 Drawing Figures

FIG. 1
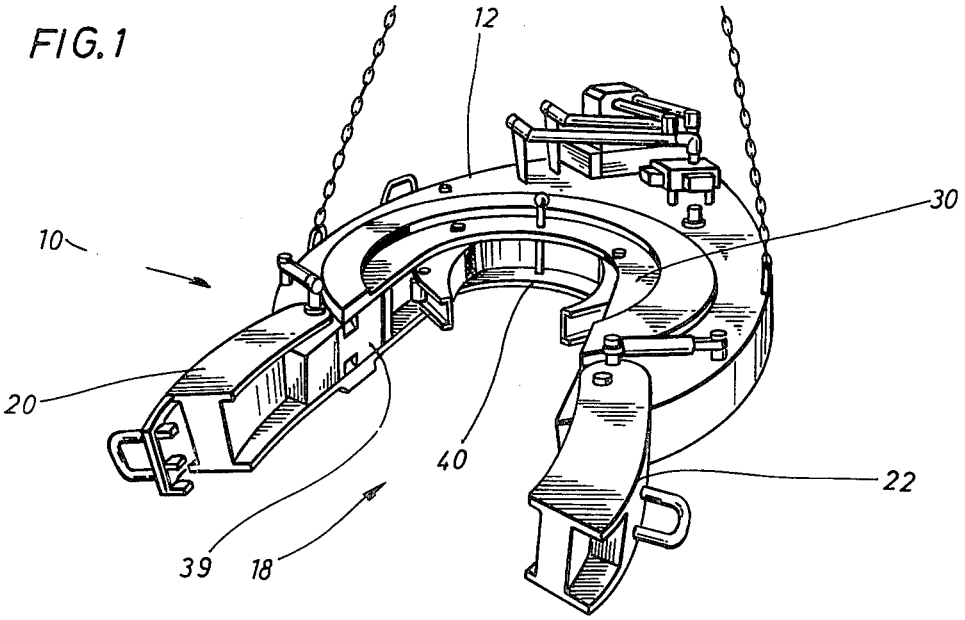
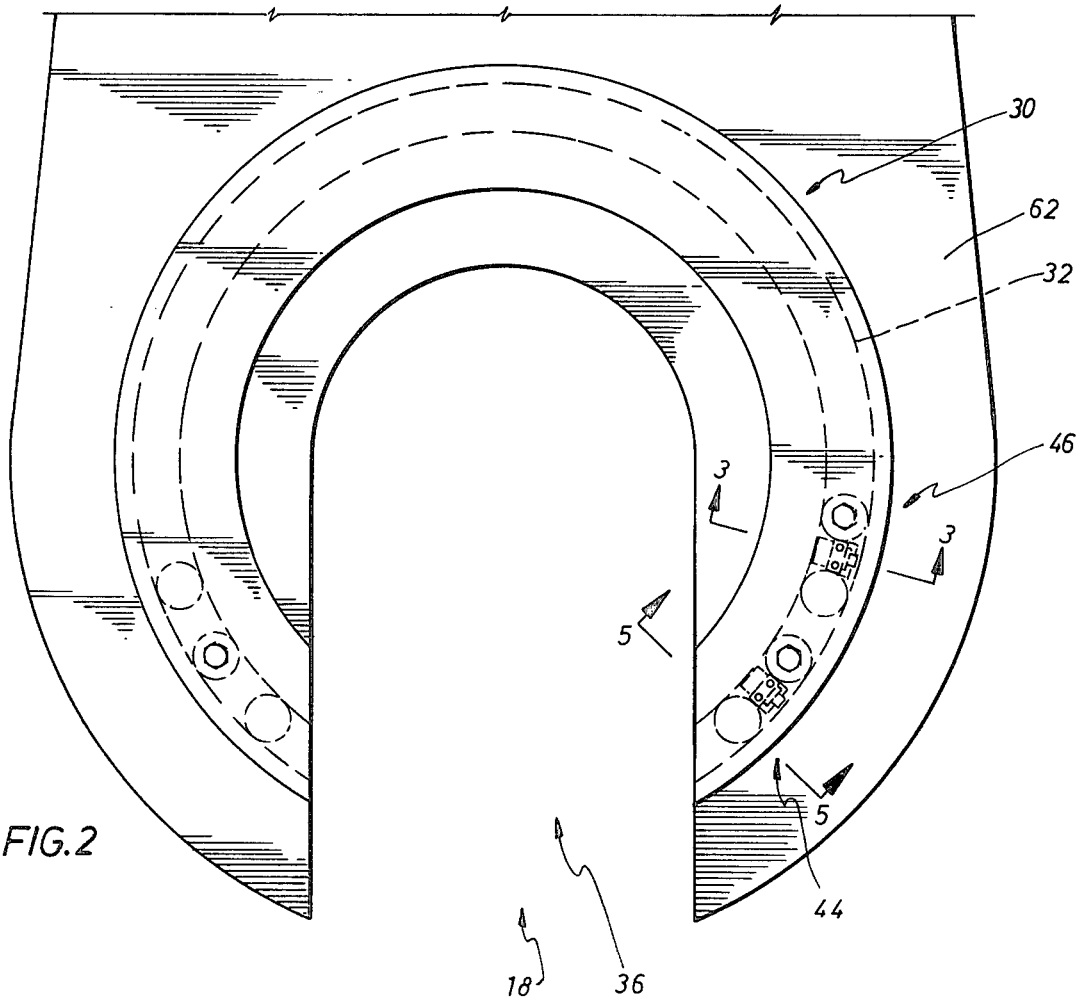
FIG. 2

POWER TONG ASSEMBLY

BACKGROUND OF THE INVENTION

1. Field of the Invention

The present invention relates to power wrenches and more specifically to power tongs for making up and breaking out threaded connections between adjoining tubular members. In particular, the invention relates to means for reducing friction at the bearing surface between the upper cage plate and the top body plate of a power tong.

2. Description of the Prior Art

Oil field tubular members, e.g. drill pipe and casing, are employed in sections which are joined together at their ends by threaded connections. Power tongs of the type herein described are utilized to make up and break out these threaded connections by securely gripping one tubular member and rotatably driving that member relative to the adjoining member. Tongs representative of present practice in the industry are described in U.S. Pat. Nos. 2,879,680; 3,180,186; 3,261,241 and 4,084,453.

When a power tong is used to grip and rotate a pipe section, a pipe-gripping mechanism, as described, for example, in U.S. Pat. No. 2,879,680, is utilized to bring a pair of jaws into contact with the pipe. The jaws are pivotally mounted by bolts which pass through the jaws. The bolts are secured at their ends to the so-called "upper and lower cage plates". The cage plates are generally arcuate plates that are adapted to rotate with the jaws when the pipe is securely gripped. The cage plates may rotate opposite plates on the tong body. Generally, the upper and lower cage plates are joined together by bolts or the like so that the entire weight of the cage plates is borne at the bearing surface between the upper cage plate and its opposing top body plate. Therefore, during rotation of the cage plates, it is desirable to reduce friction and other undesirable forces at the bearing surface between the upper cage plate and the top body plate. The friction encountered at this bearing surface can have dramatic effects on the overall efficiency of tong operation. In prior art devices the upper cage plate is typically in a metal-to-metal contact with the top body plate, thereby causing a great deal of friction during operation. The foregoing tong structure and operation is well-known to those skilled in the art and is shown, for example, in U.S. Pat. No. 2,879,680.

Consequently, there is an acute need for safe, simple and reliable means for reducing friction and other undesirable forces at the interface between a tong cage plate and its opposing tong body plate.

SUMMARY OF THE INVENTION

In accordance with the present invention there is provided a novel power tong of the type having upper and lower cage plates for carrying the pipe engaging jaws of the tong, the cage plates being mounted for rotation whereby at least one of the cage plates opposes an opposing tong body plate to define a bearing surface therebetween. The tong is provided with structure at the interface between the cage plate and the body plate comprising a continuous arcuate groove in the cage plate, the arcuate groove opening toward the opposing body plate and defining inner and outer arcuate walls; a plurality of guide roller assemblies associated with the arcuate groove and being mounted by the opposing body plate, each guide roller assembly comprising a guide roller for residing within the groove and a substantially vertical shaft secured to the opposing body plate for rotatably mounting its respective guide roller, whereby the guide rollers guide the rotation of the cage plate by engagement with the groove inner and outer arcuate walls; and a plurality of weight relief roller assemblies associated with the cage plate and being mounted by the opposing body plate, each weight relief roller assembly comprising a weight relief roller for residing within the groove in the cage plate and a substantially horizontal shaft mounted by the opposing body plate for rotatably mounting its respective weight relief roller; whereby the weight relief rollers relieve at least a portion of the force between the cage plate and its opposing body plate by riding on the groove base wall.

In accordance with the invention, the guide roller assemblies and weight relief roller assemblies may be positioned in alternate fashion along the arcuate groove. The weight relief roller assemblies may include support members which are fixedly secured to the adjacent body plate, with the support members being used as journals for the horizontal shafts. The support members may be mounted to the body plates by means of threaded fasteners, by means of welding, or by other suitable means. In a preferred embodiment, the weight relief rollers are formed from metal.

In another aspect, the present invention comprises a power tong having a frame, a cage plate guided by suitable means for rotation opposite a frame portion to define a bearing surface, and a plurality of weight relief rollers mounted by the body plate for rolling weight-relieving engagement with the cage plate.

Accordingly, a primary feature of the present invention is the provision of a power tong having means for reducing friction and other undesirable forces at the interface between a cage plate and an opposing tong body plate. The reduction of friction and other undesirable forces, in turn, increases the efficiency of the power tong during make up and break out operations.

These and other features and meritorious advantages of the present invention will become apparent upon consideration of the drawings and the accompanying detailed description of preferred embodiments.

BRIEF DESCRIPTION OF THE DRAWINGS

FIG. 1 is a pictorial view of a power tong constructed in accordance with the present invention.

FIG. 2 is a plan view of the upper cage plate and a portion of the tong body with portions of the tong removed for purposes of illustration. Two adjacent roller assemblies are shown in dashed lines.

DETAILED DESCRIPTION OF THE PREFERRED EMBODIMENT

Figure 3:
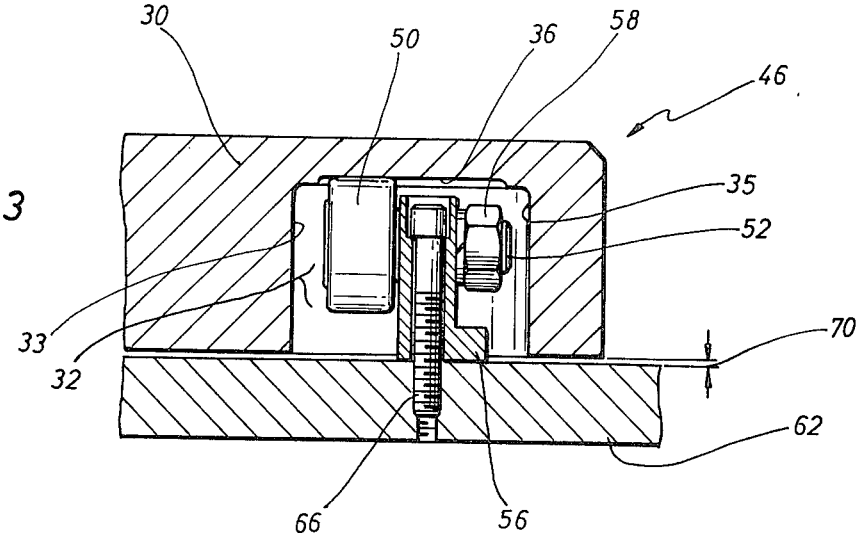
FIG. 3 is a section view taken substantially along line 3—3 of FIG. 2 showing one weight relief roller assembly associated with the upper cage plate.

Referring to the drawings and in particular to FIG. 1, there is shown in pictorial view an open-mouth power tong 10 constructed in accordance with the present invention. Tong 10 includes a frame 12 comprising upper and lower surfaces connected by sidewalls. A body plate of the upper surface supports an upper cage plate 30 which, in turn, pivotally supports the jaws utilized to grip the pipe sections. A lower cage plate 40 is connected for rotation with the upper cage plate 30 and also supports the jaws. Frame 12 defines a frontal throat 18 for receiving the pipe sections. When a pipe section is centrally located within the frame during operation, throat 18 is closed off by means of pivotally mounted door members 20, 22 in the manner well-known in the art.

FIG. 2 is a view looking down on the upper cage plate 30 and a portion of the tong top body plate 62. Upper cage plate 30 is generally arcuate and includes a frontal opening 36 for aligning with the throat 18 and the mouth of the rotary gear 39. Lower cage plate 40 (shown in FIG. 1 only) is secured to upper cage plate 30 by bolts or the like for rotation therewith. Cage plates 30 and 40 comprise rotatable means for carrying the jaws.

Figure 5:
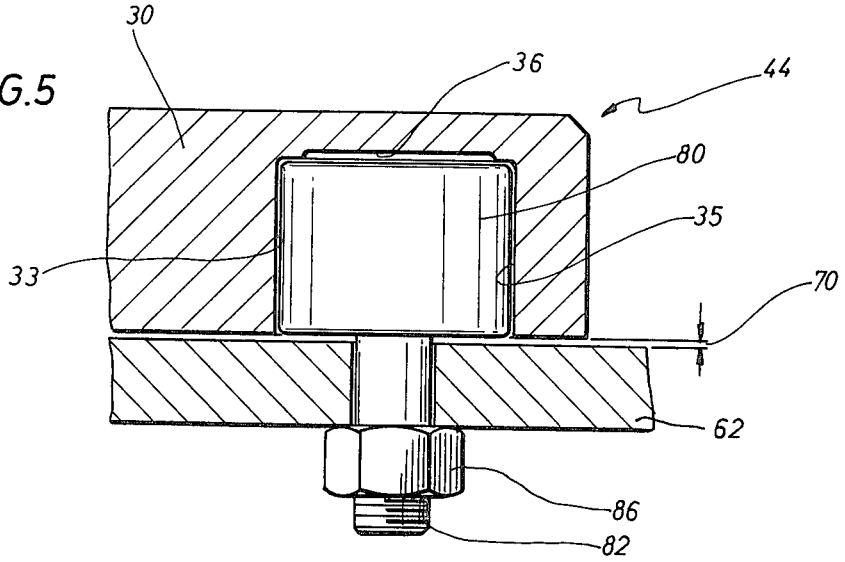
FIG. 5 is a section view taken substantially along line 5—5 of FIG. 2 showing one of the guide roller assemblies associated with the upper cage plate.

As shown in FIGS. 2 and 3, upper cage plate 30 includes an arcuate groove 32. Groove 32 includes an inner wall portion 33, an outer wall portion 35 and a base wall 36 (FIGS. 3 and 5). Located within the groove are a plurality of roller assemblies comprising guide roller assemblies 44 and weight relief roller assemblies 46. Although not illustrated, in a preferred embodiment the assemblies 44 and 46 reside in alternate positions along the groove.

Figure 4:
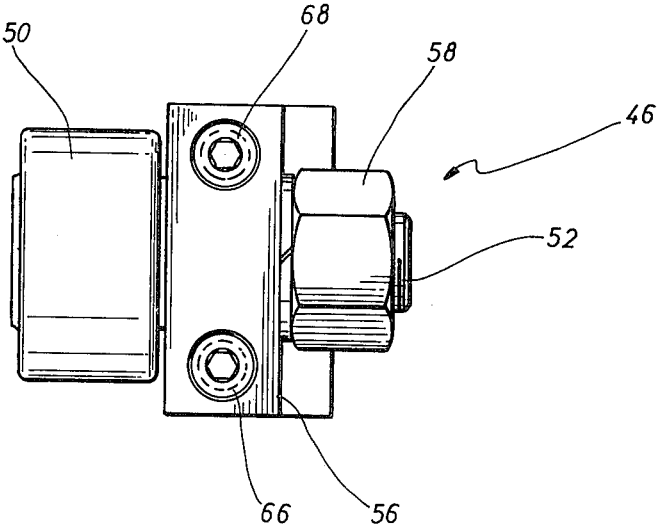
FIG. 4 is a top view of the weight relief roller assembly shown in FIG. 3.

Referring to FIGS. 3 and 4, the details of one of the weight relief roller assemblies 46 will be described. Assembly 46 includes a roller 50 rotatably mounted on a substantially horizontal shaft comprising a bolt 52. Bolt 52 passes through an opening in a support member 56 and is held in place by a nut 58. Support member 56 may be secured to the top tong body plate 62 by any suitable means. In the illustrated embodiment, a pair of threaded fastening pins 66, 68 pass through openings in support member 56 and are secured in mating openings in plate 62. In a particular embodiment, the pins 66, 68 are tightenable into the plate openings by means of an allen wrench. With reference to the portion of upper cage plate 30 shown in FIG. 3, it can be seen that each weight relief roller 50 supports a portion of the weight of cage plate 30 and the affixed lower cage plate 40. In the preferred embodiment assemblies 46 provide a gap 70 between plate 62 and cage plate 30. While the provision of a gap may not be necessary for all applications, it is preferred since it eliminates the metal-to-metal contact between plate 62 and cage plate 30. A gap 70 on the order of $\frac{1}{8}$ inch has been found suitable. The gap may be varied by providing supports 56 which hold the roller axis (bolt 52) at various heights above plate 62. The gap may also be varied by providing different size rollers 50.

It will be appreciated that the weight relief rollers serve the additional function of being leveling devices for assuring that the cage plates rotate evenly without the wobbling associated with prior tongs. Because tong bodies are typically hot rolled, the body plates usually vary in thickness. Therefore, a cage plate riding thereon in metal-to-metal contact tends to ride unevenly. The provision of the weight relief rollers enables the cage plate to be carried evenly with equal weight on each roller.

Turning now to FIG. 5, one of the guide roller assemblies will be described in detail. Guide roller assembly 44 includes a guide roller 80 rotatably mounted on a substantially vertical shaft comprising a bolt 82 which passes through an opening in the body plate 62 and is secured by a nut 86. The curved peripheral portion of each roller 80 is adapted to contact the inner and outer wall portions 33 and 35 of the arcuate grooves in order to center the cage plate during rotation.

It will be noted that the shafts utilized for supporting the weight relief rollers and guide rollers have been referred to as "horizontal" and "vertical" shafts, respectively. It will be appreciated that these designations are utilized for convenience only in that they correspond to the normal positions of these shafts when a power tong is positioned generally horizontally during a make up or break out operation. It should also be noted that the rollers are preferably formed from metal, but other suitable materials may be used.

While the present invention has been disclosed in connection with an illustrative embodiment, numerous modifications may be made without departing from the spirit or scope of the invention. For example, the cage plates may be guided for rotation by means other than the illustrated guide rollers, in which case the weight relief rollers alone may reside within the groove, or reside in conjunction with other means for guiding the cage plates. While the weight relief roller assemblies have been shown in association with an upper cage plate, it will be appreciated that with other tong designs weight relief rollers may operate in association with a lower cage plate. It will also be appreciated that although the weight relief rollers have been shown operating within the same groove as the guide rollers, a separate groove could be provided. Furthermore, it should also be noted that with a sufficiently large gap between the cage plate and its opposing body plate, there may be no need for a groove to receive the weight relief rollers. As a final consideration, it will be appreciated that the weight relief rollers may be so constructed, for example, utilizing universal bearings, so that the weight relief rollers contact the arcuate sides of the groove and thereby serve to guide the rotation of the cage plates. These and other modifications are within the spirit and scope of the present invention.

What is claimed is:

1. In a power tong of the type having upper and lower cage plates for carrying the pipe-engaging jaws of the tong, the cage plates being mounted for rotation whereby at least one of the cage plates opposes an opposing tong body plate to define a bearing surface therebetween, the IMPROVEMENT comprising:

a continuous arcuate groove in said at least one cage plate, said arcuate groove opening toward the opposing body plate and defining inner and outer arcuate walls and a base wall;

a plurality of guide roller assemblies associated with the arcuate groove and being mounted by the opposing body plate, each said guide roller assembly comprising a guide roller for residing within the groove and a substantially vertical shaft secured to the opposing body plate for rotatably mounting its respective guide roller, whereby the guide rollers guide the rotation of said at least one cage plate by engagement with said groove inner and outer arcuate walls; and a plurality of weight relief roller assemblies associated with said at least one cage plate and being mounted by the opposing body plate, each said weight relief roller assembly comprising a weight relief roller for residing within the groove and a substantially horizontal shaft mounted by the opposing body plate for rotatably mounting its respective weight relief roller, whereby the weight relief rollers relieve at least a portion of the force between said at least one cage plate and its opposing body plate by riding on the groove base wall.

2. A power tong as claimed in claim 1 wherein said guide roller assemblies and weight relief roller assemblies are positioned in alternate fashion along the groove.

3. A power tong as claimed in claim 1 wherein at least some of said weight relief roller assemblies include a shaft support member secured to the opposing body plate for mounting the horizontal shaft of the weight relief roller assembly.

4. A power tong as claimed in claim 4 wherein said support member is secured to its respective body plate by means of threaded fasteners.

5. A power tong as claimed in claim 3 wherein said support member is secured to its respective body plate by means of welding.

6. A power tong as claimed in claim 3 wherein said horizontal shaft comprises a bolt extending through the support member.

7. A power tong as claimed in claim 1 wherein at least some of the weight relief rollers are formed from metal.

* * * * *